US008790034B1

(12) United States Patent
Schumaier

(10) Patent No.: US 8,790,034 B1
(45) Date of Patent: Jul. 29, 2014

(54) GOLF TEE INSERTION DEPTH MARKER

(71) Applicant: Daniel R. Schumaier, Elizabethton, TN (US)

(72) Inventor: Daniel R. Schumaier, Elizabethton, TN (US)

( * ) Notice: Subject to any disclaimer, the term of this patent is extended or adjusted under 35 U.S.C. 154(b) by 0 days.

(21) Appl. No.: 14/035,523

(22) Filed: Sep. 24, 2013

(51) Int. Cl.
*B43K 29/00* (2006.01)

(52) U.S. Cl.
USPC ..... 401/195; 473/386; 401/266

(58) Field of Classification Search
CPC ..... A63B 57/0018; A63B 2057/0025
USPC ..... 401/166, 195, 266; 33/666, 485; 473/386
See application file for complete search history.

(56) References Cited

U.S. PATENT DOCUMENTS

| | | | | |
|---|---|---|---|---|
| 3,074,719 | A * | 1/1963 | McKee | 473/386 |
| 3,480,371 | A * | 11/1969 | Lee | 401/121 |
| 4,982,510 | A | 1/1991 | Musillo | |
| 5,356,146 | A | 10/1994 | Blosser | |
| 5,735,758 | A | 4/1998 | Miketinac | |
| 5,885,174 | A * | 3/1999 | Barnes | 473/386 |
| 6,482,111 | B1 * | 11/2002 | Jofferion | 473/386 |
| 6,932,722 | B2 * | 8/2005 | Wood | 473/386 |
| 7,044,866 | B1 | 5/2006 | Blauvelt | |
| 7,223,184 | B2 | 5/2007 | Suwito | |
| 7,841,096 | B1 | 11/2010 | Jenkins | |
| 2004/0152542 | A1 | 8/2004 | Blum | |
| 2005/0233838 | A1 | 10/2005 | Kahl | |
| 2007/0266584 | A1 * | 11/2007 | Munson | 33/666 |

OTHER PUBLICATIONS

Haeley Giambalvo, "Design Improvised Simple project, big impact. Fathers Day Craft", Jun. 12, 2013.
Pillar Plastics, "Smart Tees", 2013.
golftees.com, "Pride Professional Tee System", Aug. 27, 2013.
thesandtrap.com, "Tee height setters—p. 2", Aug. 27, 2013.

* cited by examiner

*Primary Examiner* — David Walczak
*Assistant Examiner* — Jennifer C Chiang
(74) *Attorney, Agent, or Firm* — Luedeka Neely Group, P.C.

(57) ABSTRACT

A golf tee insertion depth marker comprises a reservoir having a fluid container. Over the reservoir is a cover having a series of spaced apart openings, each sized to receive a shaft of a golf tee. In the fluid container is an ink-impregnated sponge having wells that are sized to receive the shaft of the tee. Each well is axially aligned with a corresponding one of the openings in the cover. The bottom of the reservoir has ledges configured in stair step fashion that are aligned with the openings in the cover. When a golf tee is inserted through any of the openings, the shaft of the tee rubs against the inner surface of the well of the sponge which marks the shaft with ink. The height of the marking is determined by the height of the ledge below the tip of the tee.

18 Claims, 13 Drawing Sheets

GOLF TEE INSERTION DEPTH MARKER

FIELD

This invention relates to gauges for golf tees and, in particular, to a golf tee insertion depth marker that marks the shaft of a golf tee at a certain height to assist in ensuring that the golf tee is inserted into the ground at the desired depth consistently.

BACKGROUND

In the game of golf, a player may strike a golf ball while it lies directly on the ground surface or from a tee that has been placed into the ground. Golfers may prefer to hit the ball from a tee instead of the ground for various reasons. One reason is that the ground surface may not be suitable for hitting the ball (e.g., frozen ground). Another reason is that it places the ball more easily into the path of the golf club's head. For example, drivers have heads that are larger than most other golf clubs and are often used for the first or "tee" shot. A player will often use a golf tee to ensure that the golf ball is placed in the club's swing path thereby ensuring that the club strikes the ball squarely in order to optimize distance and trajectory of the ball.

When using a tee, a player manually pushes the shaft of the tee into the ground to a certain depth to place the top of the golf tee at a certain height above the ground surface. Varying this insertion depth varies the height at which the ball sits above the ground surface. Different clubs may require different ball heights in order to optimize the ball's distance and trajectory once it is hit. For example, for a large driver, the ball would likely be positioned higher (i.e., further from the ground), while use of a smaller club may require a ball to be positioned lower (i.e., closer to the ground).

Another reason for varying the tee height is that different golfers may have different preferences that are unique to them and may depend on a number of factors, such as their height, swing pattern, whether they want to hit a hook or slice shot, etc.

Once the golfer has determined a suitable tee height and club combination, the golfer endeavors to maintain that same combination from one shot to the next to ensure that the ball is hit consistently. Golfers who can minimize the number of variables in their game that may contribute to errors are often the most successful. Therefore, in addition to developing a consistent swing pattern, another important factor for having a successful golf game is to maintain a consistent tee height. In doing so, it is often beneficial to have some visual marking present on the golf tee itself to indicate how far the tee should be inserted into the ground. Finally, as mentioned before, the desired tee height may vary depending on the type and size of club used. Therefore, it is also preferable to have a way to easily mark the tee at different locations along the length of the shaft of the tee in order to provide for different tee heights.

What is needed, therefore, is a golf tee insertion depth marker that provides a visual depth marking on the tee itself and at adjustable heights to assist the golfer in maintaining a consistent tee height from one shot to the next.

SUMMARY

The above and other needs are met by a golf tee insertion depth marker for providing markings on the shaft of a golf tee. In one embodiment, the marker comprises a housing having a reservoir portion that includes a fluid container portion disposed adjacent a bottom portion. A cover portion is disposed over the reservoir portion. Extending through the cover portion are a plurality of spaced apart openings, each of which is sized to receive a shaft of a golf tee. A golf tee inserted through any of the openings in the cover portion enters the fluid container portion. A marking fluid is disposed in the fluid container portion for marking the shaft of the golf tee when it is inserted.

A sponge may be disposed within the fluid container portion for soaking up and holding the marking fluid and for depositing the fluid onto the shaft of the golf tee. The sponge preferably includes a plurality of wells that are sized to receive the shaft of the golf tee. Each well of the sponge is axially aligned with a corresponding one of the openings in the cover portion.

The upper surface of the bottom portion of the reservoir portion has a plurality of ledges configured in stair step fashion such that each ledge is either above or below an adjacent ledge and is substantially aligned with a corresponding one of the openings in the cover portion. With this configuration, a golf tee that is inserted through an opening extends through the fluid container portion and contacts the corresponding ledge, thereby setting the height of the marking fluid on the shaft of the tee.

In another embodiment, a golf tee insertion depth marker includes a housing having a reservoir portion that includes a fluid container portion disposed adjacent a bottom portion. A cover portion, which is disposed over the reservoir portion, has first and second openings extending through it. The first opening is sized to receive a threaded adjustment screw and the second opening sized to receive the shaft of a golf tee. The adjustment screw is disposed through the first opening, extends into the reservoir portion of the housing, and is operable to freely rotate within the first opening. Within the housing is a substantially planar depth platform, a portion of which is aligned with the second opening in the cover portion. The platform has a hole through it that is aligned with the first opening in the cover portion and is sized to receive the adjustment screw. The threads of the adjustment screw contact upper and lower surfaces of the platform adjacent the hole as the adjustment screw is rotated with respect to the housing, thereby moving the platform and varying a distance between the platform and the cover portion. A marking fluid in the fluid container portion marks the shaft of the golf tee when the golf tee is inserted into the second opening in the cover portion and seats against the platform. The height of the marking on the shaft is determined by the position of the platform within the housing.

In another embodiment, a golf tee insertion depth marker includes a housing having a bottom portion, a first side portion, a second side portion, a third side portion, and a top opening for receiving a shaft of a golf tee. A corner formed between the first and second side portions is disposed directly opposite the third side portion. A plurality of windows are formed in the third side portion of the housing. Each window is sized and configured to receive a tip portion of a marking device inserted therein. The tip portion of the marking device presses the shaft of the tee into the corner between the first and second side portions so that the shaft is laterally secured as it is rotated to make a mark around the shaft. The selection of window determines the height of the marking on the shaft of the tee.

Further details of each of these and other embodiments of the invention are provided in the drawings and in the detailed description.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
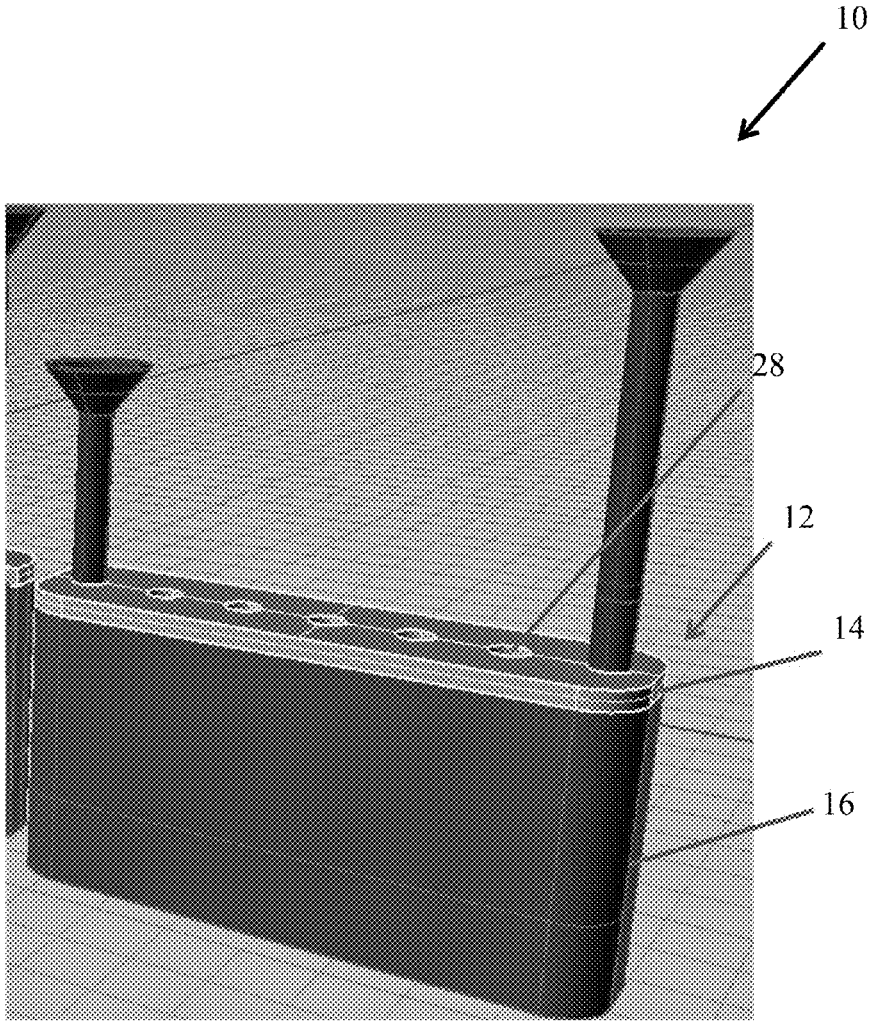
FIG. 1 depicts a golf tee insertion depth marker according to a first embodiment of the invention with tees inserted into two of the marking wells.
Figure 2:
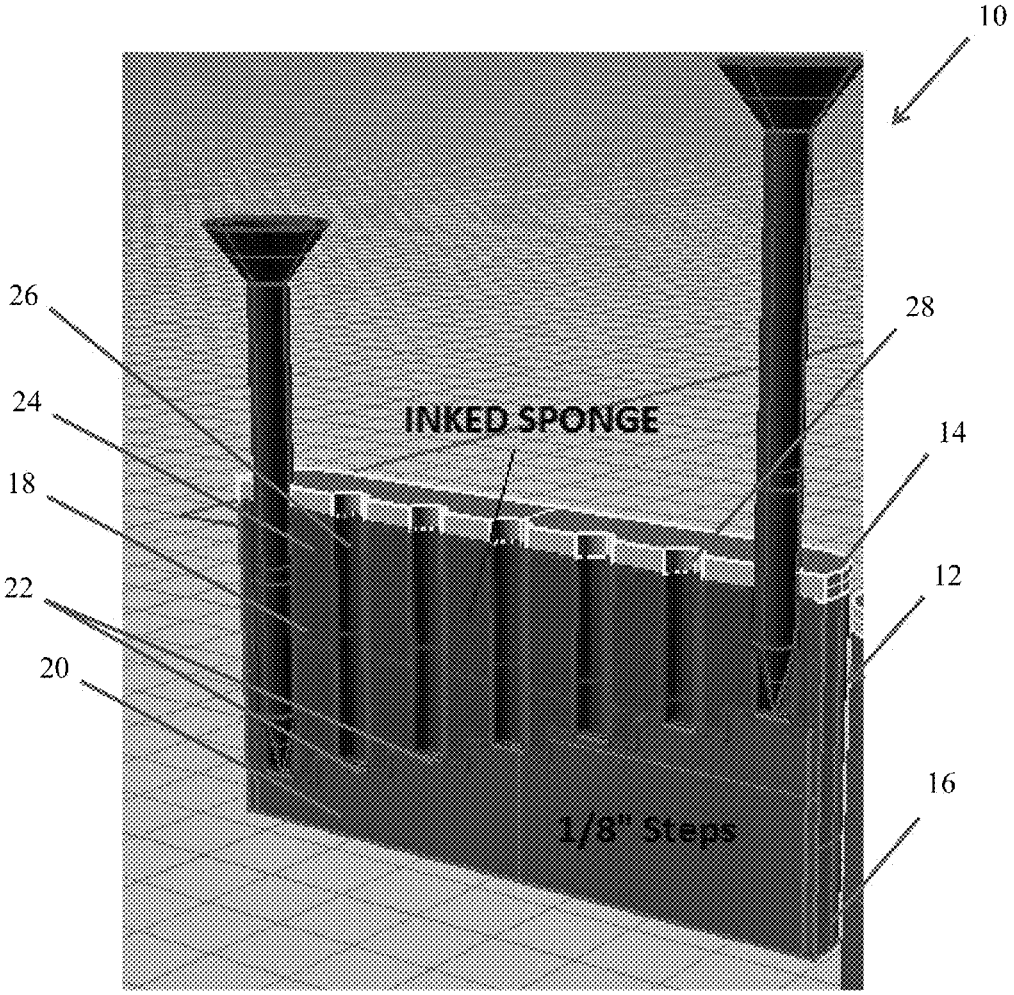
FIG. 2 depicts a cutaway view of the golf tee insertion depth marker shown in FIG. 1.
Figure 3:
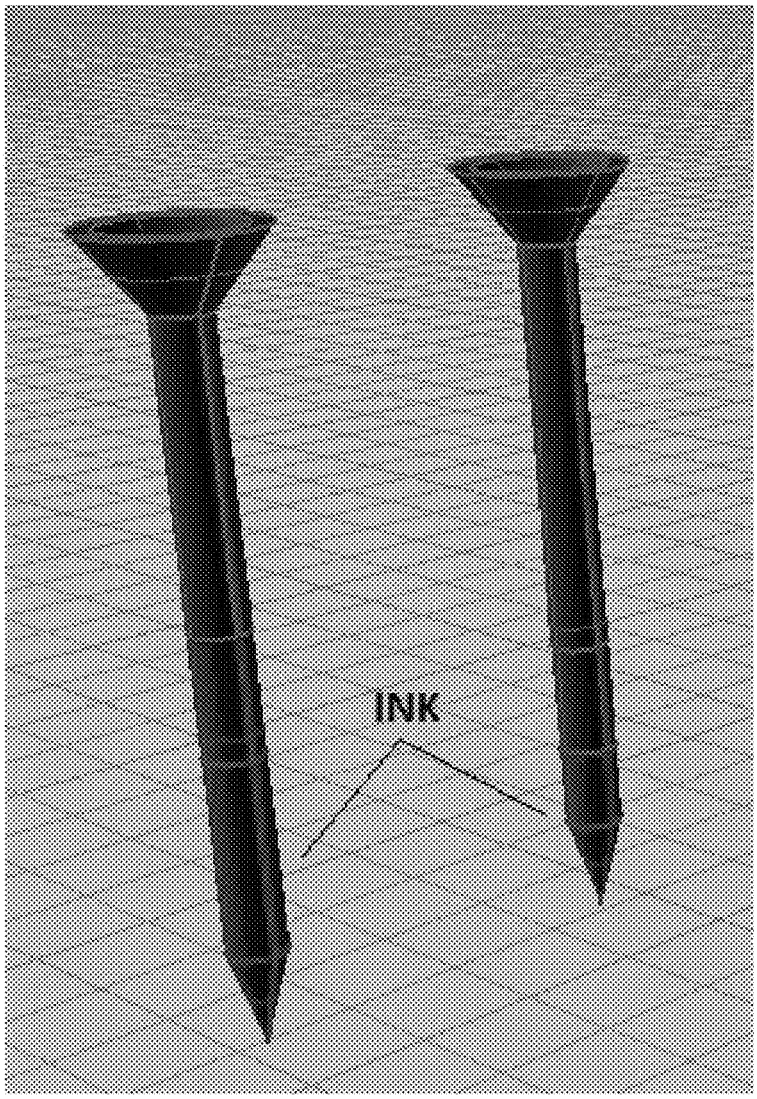
FIG. 3 depicts two tees after being removed from the golf tee insertion depth marker and demonstrating markings at two different heights.
Figure 4:
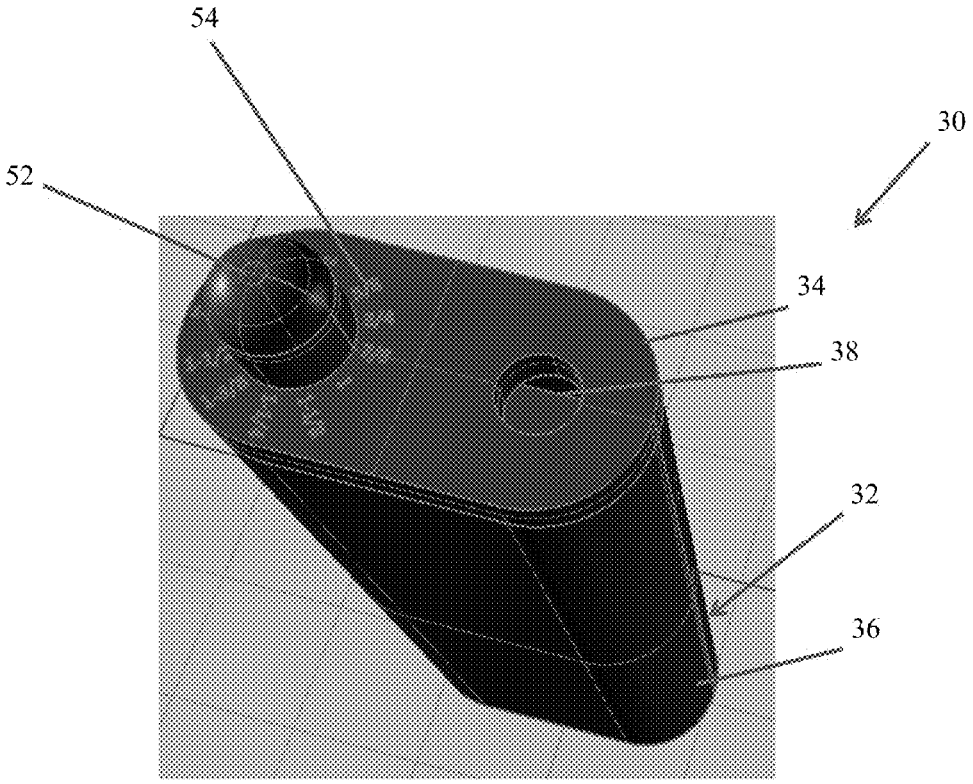
FIG. 4 is a top perspective view depicting a golf tee insertion depth marker according to a second embodiment of the invention having a single opening and a height adjustment screw and gauge.
Figure 5:
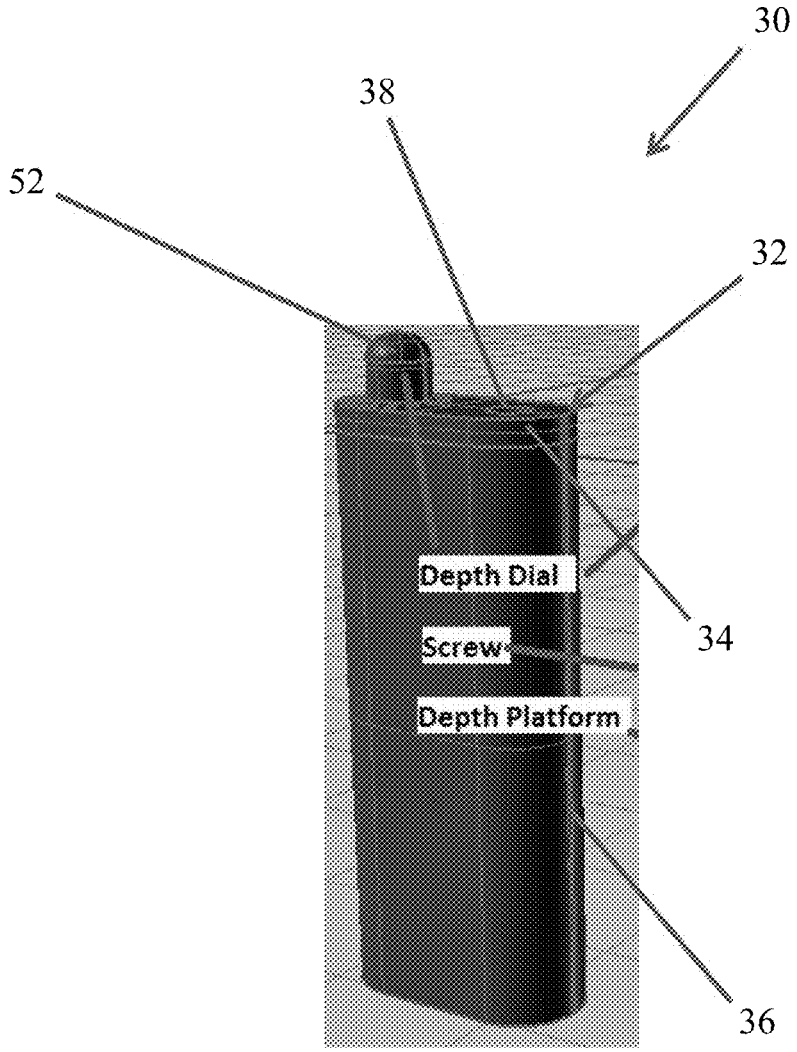
FIG. 5 is a front perspective view of the golf tee insertion depth marker shown in FIG. 4.

Turning now to the drawings in greater detail and considering first FIGS. 1-3, there is illustrated an embodiment, generally indicated 10, of a golf tee insertion depth marker within which features of the present invention are embodied. The marker 10 is in the form of a handheld device for marking golf tees that may be placed conveniently into a golf bag, for example, for easy access and use. In general, as further described below, golf tees may be inserted one of a series of wells formed into the device and a marking fluid inside of the device marks the tee. The height of that marking is determined by how far the tee is inserted into the device. Each well has a different depth such that tees may be marked at different heights by placing them into the different wells.

As shown in FIGS. 1 and 2, a preferred embodiment of the marker 10 includes an elongate generally rectangular housing 12 that is made from two pieces, an upper cover portion 14 and a reservoir portion 16 that holds the marking fluid. The reservoir portion 16 of the depicted marker 10 is preferably a one-piece component comprising a fluid container portion 18 having a hollow center area and a bottom portion 20 that are integrally joined together. However, the reservoir 16 can be constructed as a multi-component item. In a preferred embodiment, the upper cover portion 14 and the reservoir portion 16 are made of thermoplastic and are formed by injection molding or 3D printing.

The bottom 20 includes a series of ledges 22 that are formed in stair step fashion such that adjacent ledges are at different heights from one another. When a tee is inserted into the marking device 10, the height of the ledges 22 determines how far the tee may be inserted, which, in turn, determines the height at which the tee is marked. The difference in height of the ledges 22 may vary from one step to the next, or they may be uniformly spaced. For example, each ledge 22 may be $\frac{1}{4}^{th}$ of an inch higher or lower than the adjacent ledge. Alternatively, the height of two ledges 22 may be $\frac{1}{8}^{th}$ of an inch apart while the height of two other ledges may be ½ of an inch apart.

The upper cover portion 14 of the depicted marker 10 extends across the top of the marker and covers the open top of the reservoir portion 16. The cover 14 portion and the reservoir portion 16 may be permanently sealed together, such as by sonic welding or with an adhesive. Alternatively, they may be press-fit together so that the two portions may be separated from one another. Preferably, the two portions 14 and 16 are separable from one another to provide access to the fluid container portion 18 of the reservoir 16. Such access may be beneficial for refilling the marker 10 with marking fluid or for removing debris that may become trapped within the marker.

The cover portion 14 includes a plurality of openings 28, sized to permit a golf tee to be accepted into them, that are formed along the length of the cover portion 14 at distances that correspond with the ledges 22 of the bottom 20 such that each opening 28 aligns with a corresponding ledge 22 when the cover portion 14 and the reservoir portion 16 are joined together. For this and other embodiments described herein that incorporate marking fluid, plugs may be provided to seal the openings 28 when the marker is not in use to slow evaporation of the marking fluid or prevent spilling of the marking fluid.

As shown in FIG. 2, the marking device 10 also includes a sponge 24, which is of a type similar to sponges for stamps, that is infused with a marking fluid for marking the tees. The marking fluid may include pigments, inks, dyes, etc. The shape of the sponge 24 preferably mimics the shape of the interior of the marker 10, including having a bottom surface that includes stair step ledges, such that the sponge rests on the ledges 22 of the bottom 20 of the marker. Alternatively, the sponge 24 extends downward only partially into the fluid container portion 18 and is flat along its bottom surface. The sponge 24 further includes a series of passageways, bores or wells 26 disposed along its length that align with the openings 28 and are correspondingly spaced apart with the ledges 22 such that a well corresponds with each of the ledges.

The wells 26 are sized and configured to accept a golf tee when it is inserted into the marker 10 through one of the openings 28. As may be appreciated, upon inserting a tee into the marker 10, a portion of the marking fluid is transferred to the outer surface of the tee, thereby marking the tee. Accordingly, to ensure that the marking fluid is transferred effectively, the dimensions of the opening 28 and well 26 should be substantially the same as the dimensions of the shaft portion of the tee.

FIG. 3 depicts an example of tees marked at two different heights. Inserting the tee into an opening 28 that is paired with a well 26 having a greater depth causes the golf tee to be marked higher up on the shaft of the tee, which thereby indicates that the tee should be inserted further into the ground. Conversely, a more shallow well marks the tee at a lower height, which indicates that the tee should be inserted at a more shallow depth into the ground such that the ball rests higher above the ground.

It will be understood that numerous modifications and substitutions can be made to the first embodiment of a marker 10 described above without departing form the spirit of the invention. For example, although the embodiment 10 includes several openings 28, wells 26, and ledges 22 that are formed along the length of an elongate housing 12, the length of the housing may be significantly shorter and include a single opening, well and ledge. For example, FIGS. 4-7 illustrate an alternative embodiment of a golf tee insertion depth marker 30 having a housing 32 that is made from two pieces: an upper cover portion 34 and a reservoir portion 36 that holds the marking fluid. As in other embodiments, a sponge impregnated with a marking fluid is disposed in the reservoir portion 36 of the housing 32. As the tee is inserted into the marker 30, marking fluid is transferred from the sponge to the tee in order to mark the tee.

Figure 6:
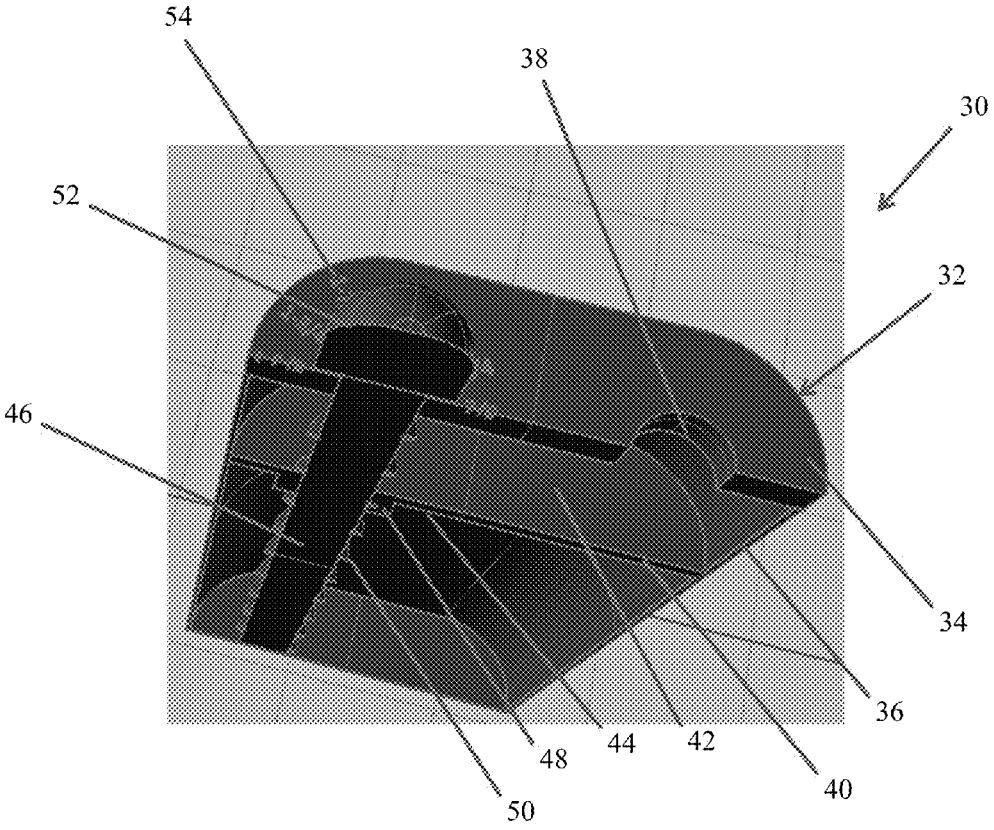
FIG. 6 is a top perspective cutaway view of the golf tee insertion depth marker of FIG. 4.
Figure 7:
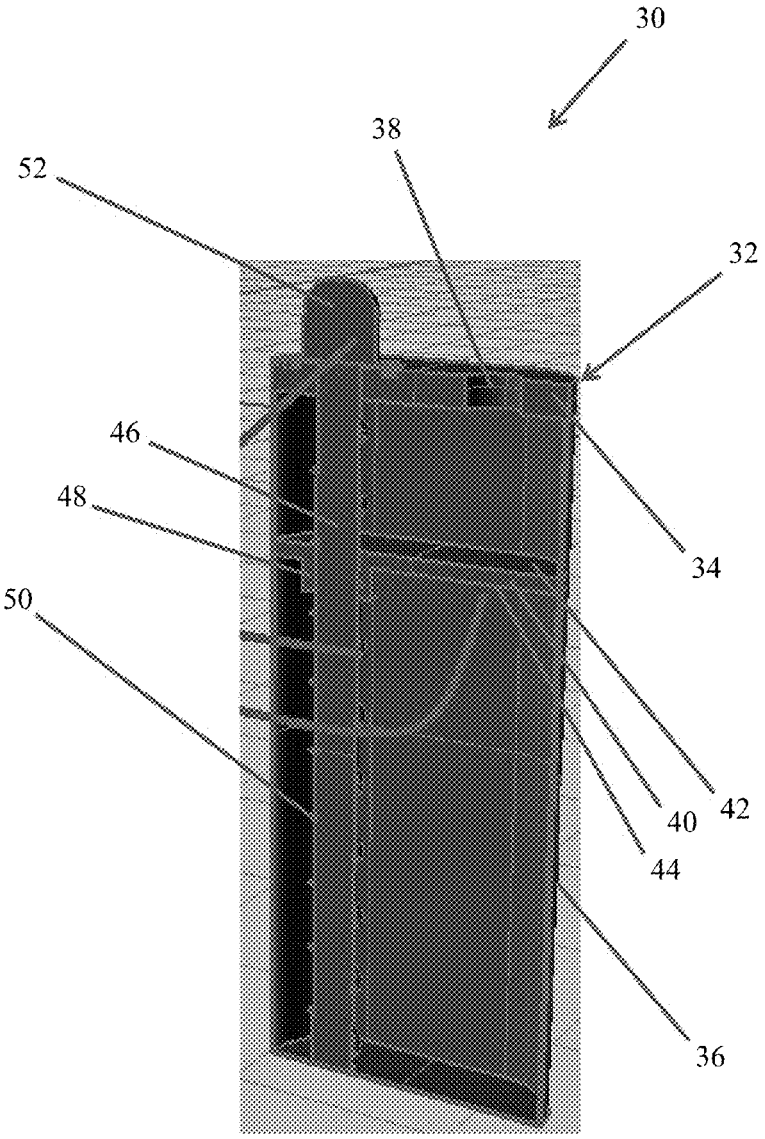
FIG. 7 is a front perspective cutaway view of the golf tee insertion depth marker of FIG. 4.

The marker 30 preferably includes a single opening 38 through which a tee may be inserted into the marker. As shown in FIG. 6, a depth platform 40 is disposed within the reservoir portion 36 of the housing for determining how far a tee may be inserted into the reservoir portion 36. The depth platform 40 is preferably a flat platform having a first surface 42 and a second surface 44 and an aperture formed through it. The platform 40 is sized to fit within and travel along the inside of the walls of the reservoir portion 36 of the marker 30. Moving the platform 40 upwards causes the distance between the first surface 42 of the platform and the opening 38 to be reduced, which causes the height of the marking on the tee to be lowered. Conversely, moving the platform 40 downward causes the distance between the first surface 42 of the platform and the opening 38 to be increased, which causes the height of the marking on the tee to be higher.

This adjustment may be made using an adjustment screw 46, which is located within the reservoir portion and extends through the aperture in the depth platform 40. A lip 48, surrounds the aperture on the second surface 44 of the platform 40, rests on threads 50 of the screw 46. As the screw 46 is turned, the lip 48 travels along the threads 50 of the screw thereby causing the platform 40 to be raised or lowered, depending on the direction that the screw is turned. As shown best in FIG. 4, the screw 46 is turned using the external depth dial 52. Preferably, indicia 54 are provided on or near the depth dial 52 to indicate the depth to which a tee may be inserted into the platform 40. To mark a golf tee using the marker 30, the desired depth of insertion is first selected using the depth dial 52. The golf tee is then inserted into the opening 38 until the tip of the tee comes into contact with the platform. To mark a tee at a different depth, the depth dial is then adjusted and the process of marking is repeated. The indicia may be provided in various increments, such as $\frac{1}{4}^{th}$ or $\frac{1}{8}^{th}$ of an inch. This will enable a user to quickly and easily select a preferred depth by simply turning to the desired depth. However, one notable advantage of this design is that a user may optionally select a depth that is between the indicia markings 54. For example, a user might prefer a depth that is between $\frac{7}{8}^{th}$ of an inch and one inch. In that instance, the dial 52 could be turned to a desired position between these two indicia 54, thereby providing an infinite number of marking possibilities.

Figure 13:
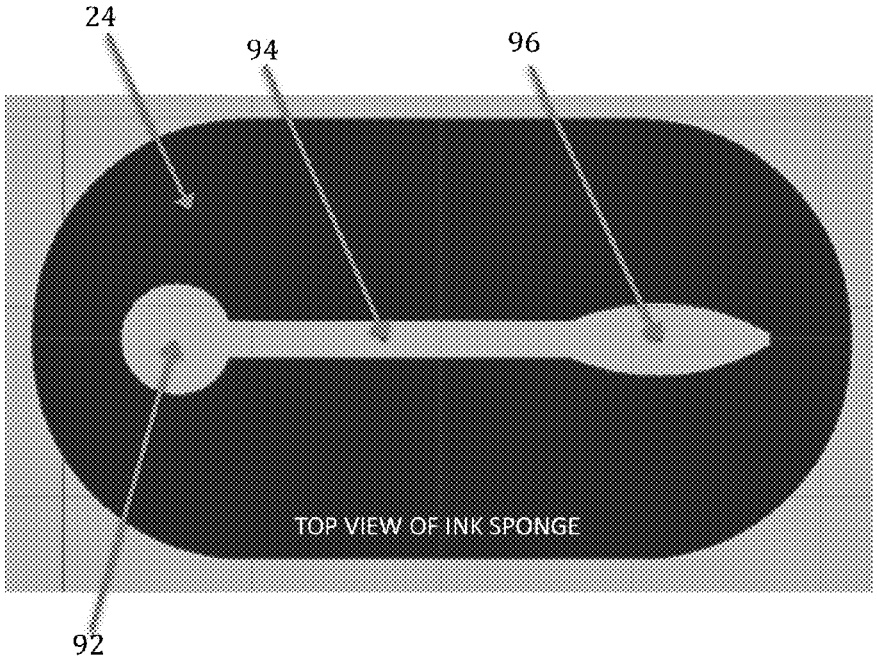
FIG. 13 is a cross section view of an ink sponge of a golf tee insertion depth marker according to the embodiment of FIG. 4.

The size, configuration and location of the sponge in the embodiment of FIGS. 4-7 may vary. In one preferred embodiment depicted in cross-section in FIG. 13, the sponge 24 is sized so that it fills substantially the entire reservoir area 36. In that instance, the sponge may be provided with a slot 94 that enables the platform 40 to travel within the reservoir area 36. Slots 92 and 96 are provided in the sponge 24 to accommodate the screw 46 and receive the tee. In some embodiments, the sponge 24 is sized such that it occupies only a portion of the reservoir area 36. Preferably, the sponge is positioned within the reservoir area 36 immediately adjacent to and extending a short distance away from the upper cover portion 34, such that the sponge is located between the platform 40 and the upper cover portion. In this configuration, the slot 94 is not necessary since the platform 40 does not travel through the sponge 24.

Figure 8:
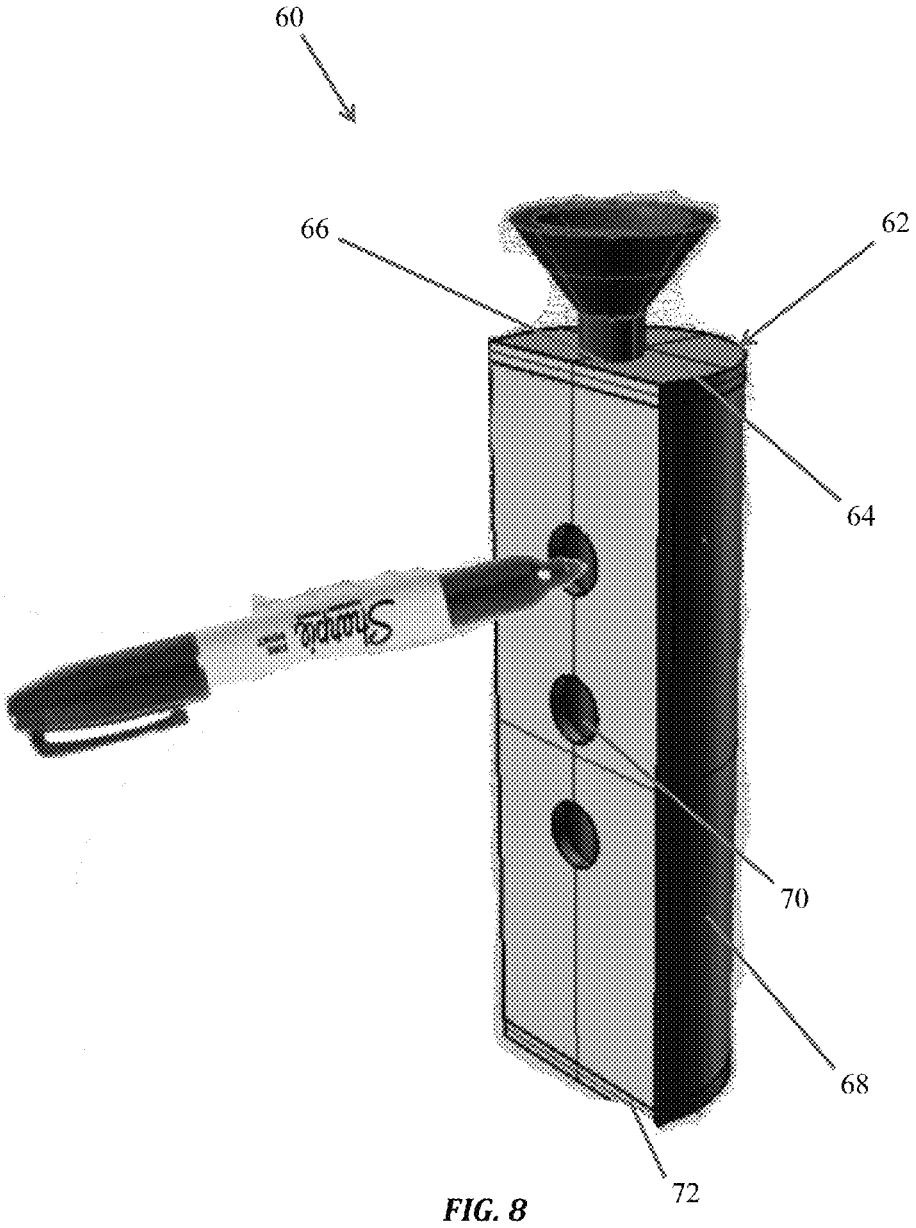
FIG. 8 is a perspective view depicting a golf tee insertion depth marker according to a third embodiment having a single opening and a plurality of marking windows.
Figure 9:
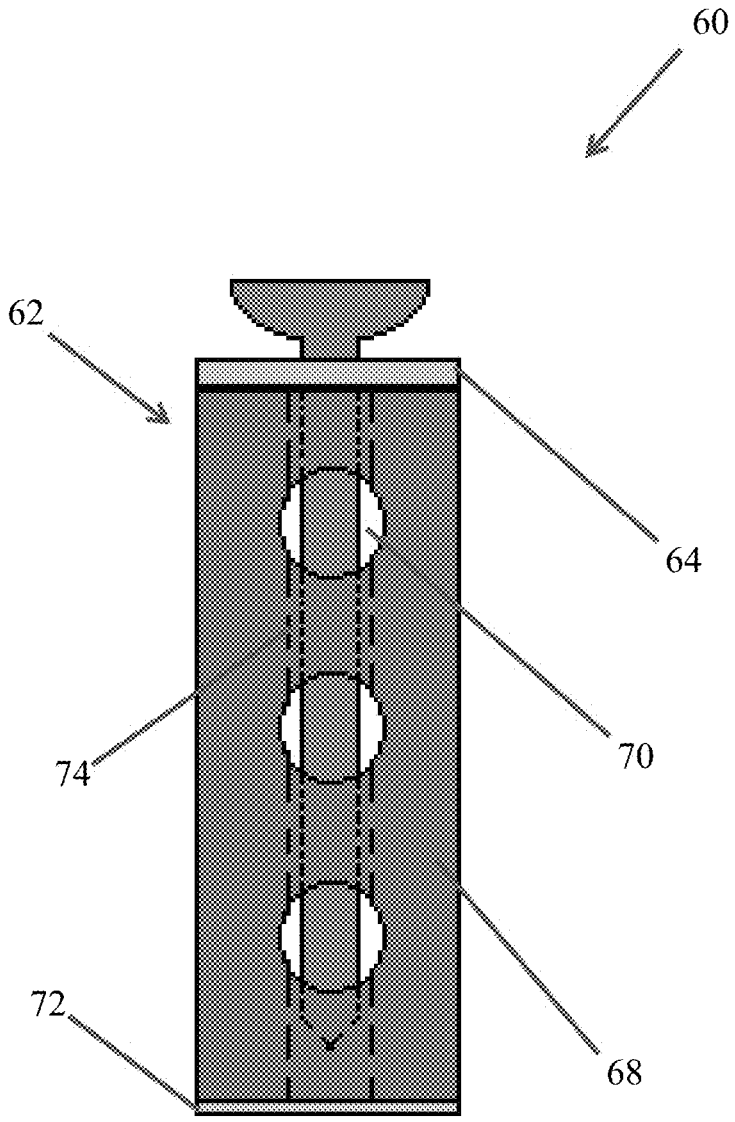
FIG. 9 is a front elevation view depicting the golf tee insertion depth marker of FIG. 8.
Figure 10:
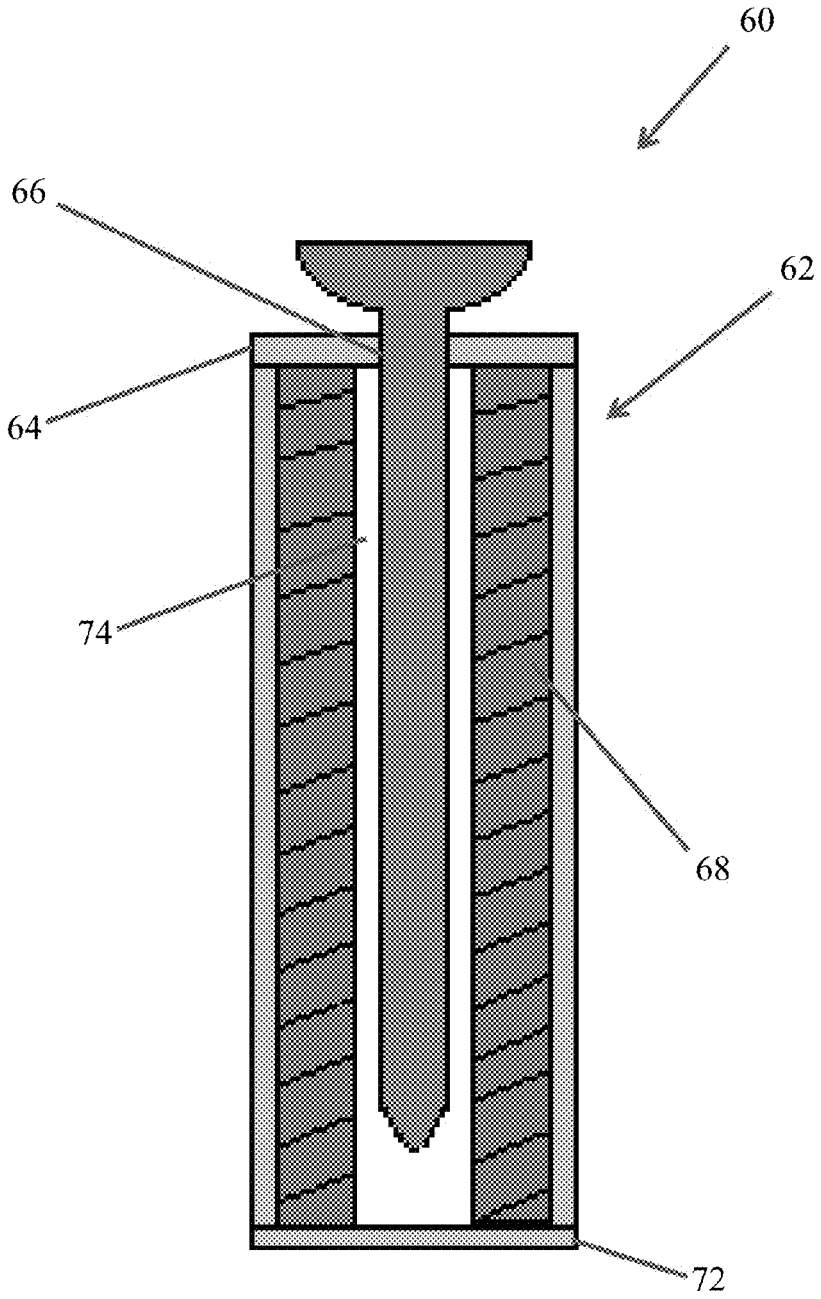
FIG. 10 is a front cutaway view depicting the golf tee insertion depth marker of FIG. 8.

With reference now to FIGS. 8-10, a golf tee insertion depth marker 60 according to a third embodiment is depicted. Unlike the aforementioned embodiments 10 and 30, this embodiment 60 does not require a tee to be inserted into a reservoir of marking fluid. Rather, an external marking device, such as a permanent marker or ink pen, may be used to mark the tee.

The marker 60 comprises a housing 62 that includes an upper cover portion 64, including an opening 66 to allow for a tee to be inserted into the housing, an elongate lower marking portion 68, including a plurality of windows 70 formed along the side of the housing, a bottom portion 72, and a central channel 74 for receiving the shaft of a golf tee. The cover portion 64, lower marking portion 68, and bottom portion 72 of the depicted marker 60 preferably form a one-piece component that is integrally joined together. However, the marker 60 can be constructed as a multi-component item. In a preferred embodiment, the upper cover portion 64, the lower marking portion 68 and bottom 72 are made of thermoplastic and are formed by injection molding or 3D printing.

This marker 60 permits a user to mark the entire perimeter of the tee quickly and easily at various heights along the shaft of the golf tee. The first step is to insert the shaft of the tee into the marking device through the opening 66 and into the channel 74. The opening 66 and channel 74 are preferably large enough to permit the tee to easily turn within the opening. However, these features are preferably small enough that the movement of the tee is limited to prevent skewed marking caused by excessive movement. As depicted in the drawings, the tee may be inserted until the bottom surface of the head of the tee contacts the upper surface of the cover portion 64 at the opening 66.

As shown best in FIGS. 8 and 9, once the tee has been inserted, portions of the shaft of the tee are visible through the windows 70 disposed at various heights along the side of the marker 60. The windows 70 shown in the figures are exaggerated in size for illustration purposes only. The windows 70 are preferably sized and configured so as to receive and securely hold the tip of a marking device, such as an ink marker, pencil or pen, such that it contacts the exterior surface of the tee. The windows 70 may be positioned at various locations along the housing 62 in order to mark the tee at various heights. For example, each window 70 may be $\frac{1}{4}^{th}$ of an inch higher or lower than the adjacent window. Alternatively, the distances between two windows 70 may vary. Although the figures show windows 70 only on one side of the marker 60 and axially aligned with the channel 74, windows may be located and spaced about the entire housing in order to provide a larger choice of marking heights. Once the tee and marker pen have been correctly positioned, the tee is then turned within the housing 62 in order to mark the perimeter of the tee.

Figure 11:
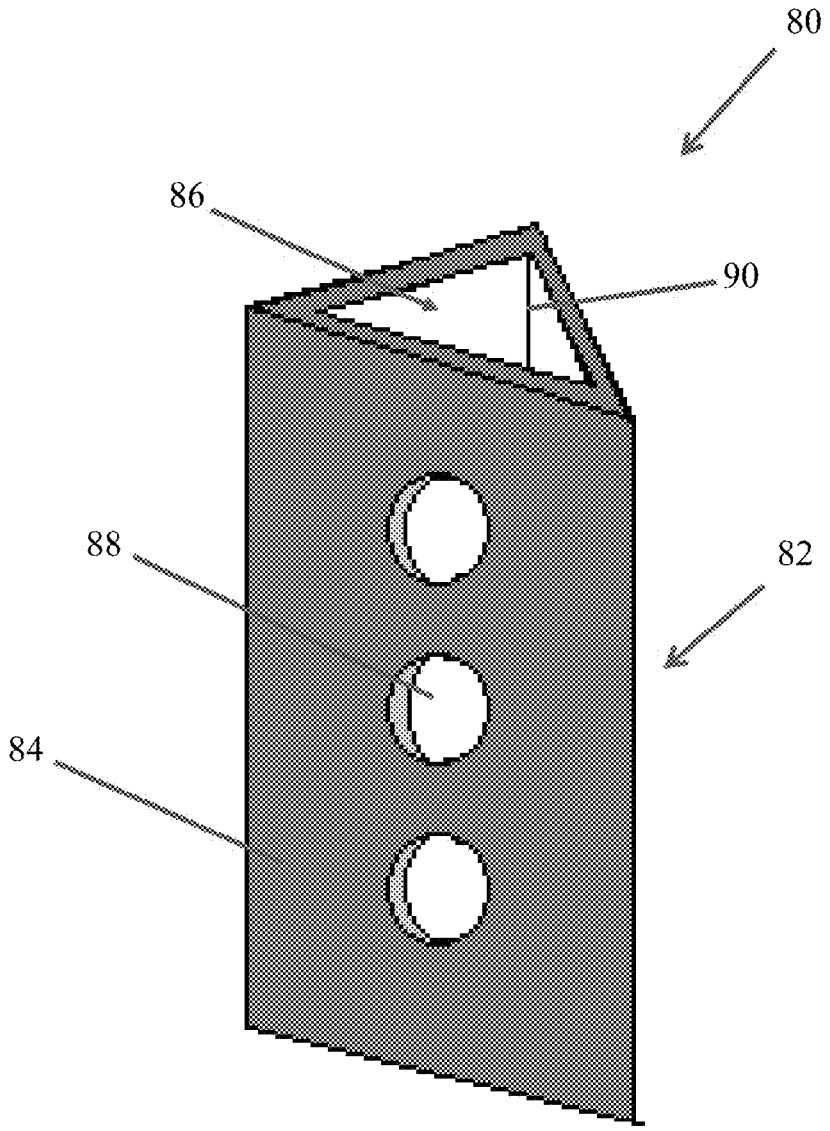
FIG. 11 is a perspective view depicting a golf tee insertion depth marker according to a fourth embodiment.

In a fourth embodiment depicted in FIG. 11, the marker 80 includes a housing 82 having sides 84 and an open top 86 that is sized to receive the shaft of a golf tee. Preferably, the open top 86 is only slightly larger than the golf tee, while at the same time being large enough to permit the tee to be easily turned within the opening.

One or more of the sides 84 also include a plurality of windows 88. As before, portions of the shaft of a tee inserted into the marker 80 would be visible through windows 88, which are positioned at various heights along the side(s) 84 of the marker. Although pictured on only one side 84 of the marker 80, windows 88 may be placed on multiple sides of the marker device. These windows 88 accommodate the tip of a marking device in a manner similar to the windows discussed above.

Figure 12:
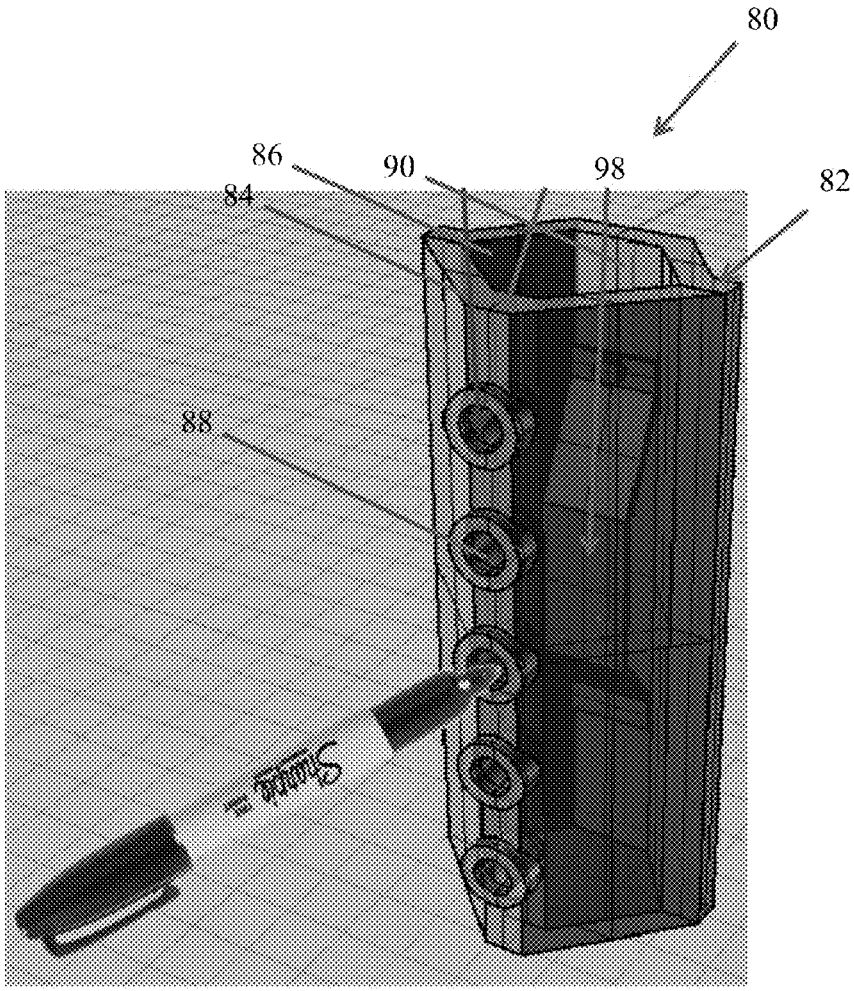
FIG. 12 is a perspective view depicting a golf tee insertion depth marker according to a fifth embodiment.

After inserting the tee into the open top 86, a marking device is then inserted into a window 88 at the desired height. The tip of the marking device presses against the shaft of the tee, thereby urging the tee against a corner 90 where two sides of the housing meet and stabilizing the tee as it is turned and marked with the marking device. As previously mentioned, windows 88 may be placed on multiple sides of the housing so that a variety of marking heights are available. Accordingly, the housing 82 of the marker 80 is preferably triangular in cross section as shown in FIG. 11, so that it would function in the same manner from all sides. However, the marker 80 may be formed in shapes other than triangular, such as shown in the embodiment of FIG. 12 which includes a leaf spring 98 that urges the shaft of the tee against the inside of the front side 84 of the housing 82 in which the windows 88 are disposed.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A golf tee insertion depth marker for providing markings on a shaft of a golf tee, the marker comprising:

a housing comprising:

a reservoir portion including a fluid container portion disposed adjacent a bottom portion; and a cover portion disposed over the reservoir portion, the cover portion having a plurality of spaced apart openings extending through the cover portion, each opening sized to receive the shaft of the golf tee through which the shaft may enter the fluid container portion of the reservoir portion;

a marking fluid disposed in the fluid container portion for marking the shaft of the golf tee when the shaft is inserted into one of the openings in the cover portion; and at least one sponge disposed within the fluid container portion for soaking up and holding the marking fluid and for depositing the fluid onto the shaft of the golf tee, the at least one sponge including a plurality of wells formed in the sponge that are sized to receive the shaft portion of the golf tee, each well of the plurality of wells axially aligned with a corresponding one of the plurality of openings in the cover portion.

2. A golf tee insertion depth marker for providing markings on a shaft of a golf tee, the marker comprising:

a housing comprising:

a reservoir portion including a fluid container portion disposed adjacent a bottom portion; and a cover portion disposed over the reservoir portion, the cover portion having a plurality of spaced apart openings extending through the cover portion, each opening sized to receive the shaft of the golf tee through which the shaft may enter the fluid container portion of the reservoir portion; and a marking fluid disposed in the fluid container portion for marking the shaft of the golf tee when the shaft is inserted into one of the openings in the cover portion, wherein the bottom portion has an upper surface adjacent the fluid container portion, the upper surface having a plurality of ledges configured in stair step fashion such that each ledge of the plurality of ledges is either above or below an adjacent ledge and is substantially aligned with a corresponding one of the plurality of openings, such that a golf tee inserted through an opening extends through the fluid container portion and contacts the corresponding ledge.

3. The golf tee insertion depth marker of claim 2 further comprising at least one sponge disposed within the fluid container portion, the at least one sponge having a lower surface comprising a plurality of ledges configured in a stair step fashion corresponding to the ledges in the upper surface of the bottom portion of the housing.

4. The golf tee insertion depth marker of claim 2 wherein each ledge of the plurality of ledges is spaced vertically above or below the adjacent ledge by a distance of between about $1/16^{th}$ inch and ½ inch.

5. The golf tee insertion depth marker of claim 2 wherein a vertical spacing between each ledge of the plurality of ledges is uniform.

6. A golf tee insertion depth marker for providing markings on a shaft of a golf tee, the marker comprising:

a housing comprising a reservoir portion including a fluid container portion disposed adjacent a bottom portion;

a cover portion disposed over the reservoir portion, the cover portion having first and second openings extending through the cover portion, the first opening sized to receive an adjustment screw and the second opening sized to receive the shaft of a golf tee and through which the shaft may enter the fluid container portion of the reservoir portion;

an elongate threaded adjustment screw disposed through the first opening of the cover portion and extending into the reservoir portion of the housing, the adjustment screw operable to freely rotate within the first opening;

a substantially planar depth platform disposed within the housing, at least a portion of the platform aligned with the second opening in the cover portion, the platform having a hole formed there through that is aligned with the first opening in the cover portion, the hole sized to receive the adjustment screw such that threads of the adjustment screw contact upper and lower surfaces of the platform adjacent the hole as the adjustment screw is rotated with respect to the housing, thereby moving the platform and varying a distance between the platform and the cover portion; and a marking fluid disposed in the fluid container portion for marking the shaft of the golf tee as the golf tee is inserted into the second opening in the cover portion and seats against the portion of the platform aligned with the second opening, whereby the distance between the platform and the cover portion determines a height of the marking on the shaft of the golf tee.

7. The golf tee insertion depth marker of claim 6 further comprising a depth dial disposed adjacent an exterior surface of the housing and secured to an end of the elongate adjustment screw extending through the first opening in the cover portion, the depth dial operable for rotating the adjustment screw.

8. The golf tee insertion depth marker of claim 7 further comprising indicia disposed on an outer surface of the cover portion adjacent the depth dial.

9. The golf tee insertion depth marker of claim 6 further comprising at least one sponge disposed within the reservoir portion for holding the marking fluid and for depositing the fluid onto the shaft of the golf tee, the at least one sponge including a well formed in the sponge that is sized to receive the shaft of the golf tee, the well axially aligned with the second opening in the cover portion.

10. The golf tee insertion depth marker of claim 9 wherein the at least one sponge is disposed between the cover portion and the depth platform.

11. A golf tee insertion depth marker for providing markings on a shaft of a golf tee, the marker comprising:

a housing comprising a bottom portion, at least one planar side portion, and at least one top opening for receiving the shaft of the golf tee; and a plurality of windows formed in the at least one side planar portion of the housing, each window sized and configured to receive a tip portion of a marking device inserted therein, whereby the tip portion of the marking device may make contact with and mark the shaft of a tee that has been inserted into the at least one top opening.

12. The golf tee insertion depth marker of claim 11 wherein the at least one planar side portion comprises a planar side portion joined together with at least one planar or nonplanar side portion to form at least one corner there between.

13. The golf tee insertion depth marker of claim 12 wherein the windows are formed in more than one of the side portions of the housing.

14. The golf tee of claim 12 wherein the side portions comprise first, second and third side portions joined together to form a housing that is triangular in cross section.

15. The golf tee of claim 14 wherein the housing is formed in the shape of an equilateral triangle, such that a corner formed between adjacent first and second side portions is disposed directly opposite the third side portion.

16. The golf tee insertion depth marker of claim 15 wherein the windows are formed in the third side opening of the housing and the shaft of the golf tee is urged into the corner between the first and second side portions when the tip portion of the marking device passes through one of the windows and presses against the shaft of the golf tee.

17. The golf tee insertion depth marker of claim 11 wherein the top opening comprises a circular aperture having an inner diameter that is smaller than an outer diameter of a lower surface of a head of the golf tee.

18. A golf tee insertion depth marker for providing markings on a shaft of a golf tee, the marker comprising:

a housing comprising a bottom portion, at least one side portion, and at least one top opening for receiving the shaft of the golf tee, the at least one top opening comprising a circular aperture having an inner diameter that is smaller than an outer diameter of a head of the golf tee, such that the head of the golf tee may not pass through the at least one top opening; and a plurality of windows formed in the at least one side portion of the housing, each window sized and configured to receive a tip portion of a marking device inserted therein, whereby the tip portion of the marking device may make contact with and mark the shaft of a tee that has been inserted into the at least one top opening.

* * * * *